US008807069B2

(12) United States Patent
Hanai et al.

(10) Patent No.: US 8,807,069 B2
(45) Date of Patent: Aug. 19, 2014

(54) ROLL BLADE COATING METHOD AND ROLL BLADE COATING APPARATUS

(75) Inventors: Shuji Hanai, Shizuoka (JP); Satoshi Nakazawa, Shizuoka (JP); Nobuyuki Nagasawa, Shizuoka (JP); Tetsuya Hara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/518,468

(22) PCT Filed: Jul. 29, 2011

(86) PCT No.: PCT/JP2011/067923

§ 371 (c)(1),
(2), (4) Date: Jun. 22, 2012

(87) PCT Pub. No.: WO2012/018103

PCT Pub. Date: Feb. 9, 2012

(65) Prior Publication Data

US 2013/0129925 A1 May 23, 2013

(30) Foreign Application Priority Data

Aug. 4, 2010 (JP) ..... 2010-174954

(51) Int. Cl.

| | |
|---|---|
| ***B05C 11/02*** | (2006.01) |
| ***B05C 11/04*** | (2006.01) |
| *B05C 9/12* | (2006.01) |

(52) U.S. Cl.

CPC ..... *B05C 11/025* (2013.01); *B05C 11/042* (2013.01); *B05C 9/12* (2013.01)

USPC ..... 118/262; 118/414; 162/281; 101/157; 101/169; 101/365

(58) Field of Classification Search

CPC ..... B05C 11/025; B05C 11/042; B05C 9/12

USPC ..... 118/261, 262, 413, 414; 162/281; 15/256.52; 101/157, 169, 365, 120

See application file for complete search history.

(56) References Cited

U.S. PATENT DOCUMENTS 4,066,014 A * 1/1978 VAN Haaften ..... 101/157
4,624,183 A * 11/1986 Kunkel et al. ..... 101/365

(Continued)

FOREIGN PATENT DOCUMENTS

| | | |
|---|---|---|
| JP | 61-57070 | 12/1986 |
| JP | 4-22470 | 1/1992 |
| JP | 5-15833 | 1/1993 |
| JP | 2005-219054 | 8/2005 |
| JP | 2005-279627 | 10/2005 |
| JP | 2009-285596 | 12/2009 |

OTHER PUBLICATIONS

International Search Report and Written Opinion in PCT/JP2011/067923, (Nov. 2011).

*Primary Examiner* — Laura Edwards
(74) *Attorney, Agent, or Firm* — Cooper & Dunham LLP

(57) ABSTRACT

A roll blade coating method including transferring an excessive amount of a coating liquid onto a continuously running web, and adjusting the excessive amount of the coating liquid to a desired adhesion amount with a roll blade, wherein the roll blade is held by a holding member for holding the roll blade, wherein the holding member is pressed by a plurality of air cylinders each configured to press the holding member, wherein the air cylinders are arranged in a side of the holding member, which side is opposite to a side where the holding member holds the roll blade, and wherein the air cylinders can separately be adjusted in air pressure.

4 Claims, 7 Drawing Sheets

(56) References Cited

U.S. PATENT DOCUMENTS

| | | | | |
|---|---|---|---|---|
| 6,379,462 | B1 * | 4/2002 | Wohlfeil et al. | 118/261 |
| 7,503,255 | B2 * | 3/2009 | Weber et al. | 101/123 |
| 7,870,833 | B2 | 1/2011 | Kobori et al. | |
| 7,943,200 | B2 | 5/2011 | Shimizu et al. | |
| 2008/0206496 | A1 | 8/2008 | Kobori et al. | |
| 2009/0151579 | A1 * | 6/2009 | Sumiyoshi | 101/169 |
| 2010/0021645 | A1 | 1/2010 | Kobori et al. | |
| 2010/0239766 | A1 | 9/2010 | Shimizu et al. | |

* cited by examiner

ROLL BLADE COATING METHOD AND ROLL BLADE COATING APPARATUS

This application is a 371 of PCT/JP2011/067923 filed Jul. 29, 2001, claiming priority of Japanese Patent application No. 2010-174954 filed on Aug. 4, 2010.

TECHNICAL FIELD

The present invention relates to a roll blade coating method and a roll blade coating apparatus, which can suppress variations in adhesion amount of a coating liquid constantly occurring on a web (a base material made of a woven fabric or a nonwoven fabric) in the width direction in roll blade coating, and obtain uniform adhesion amount of the coating liquid on the web in the width direction.

BACKGROUND ART

As a coating method in which an excessive amount of a coating liquid is transferred onto a continuously running web (a base material made of a woven fabric or a nonwoven fabric), and then measured to a desired adhesion amount, for example, a Meyer bar coating method, a blade coating method, a roll blade coating method, an air knife coating method, and the like are known.

Of these, the roll blade coating method is widely used for coating of various products, because a liquid having a high density can be applied to form a thin film.

As shown in FIG. 1, the roll blade coating method is a method in which a roll blade 31 is brought into pressure contact with a web 33 whose back surface is supported by a backup roll 32, so as to remove an excessive amount of the coating liquid 34 transferred onto the web 33. Moreover, as shown in FIG. 2, the roll blade 31 is held by a holding member 35. A tubular air containing member 36 configured to press the holding member 35 is arranged in a side of the holding member 35, which side is opposite to a side where the roll blade 31 is held. This causes force which can bring the roll blade 31 into press contact with the web 33.

FIG. 3 shows a conceptual diagram of a cross-section of A-A line in FIG. 1 and a contact pressure between the roll blade 31 and the backup roll 32 corresponding to the width direction position of the cross-section.

The tubular air containing member 36 also applies force to a part of the roll blade 31, which part is not in contact with the web 33 in the width direction. Thus, the contact pressure between the roll blade 31 and the backup roll 32 in the vicinity of both ends of the web 33 may be higher than the contact pressure therebetween at the central part of the web 33 because of unevenness caused by the thickness of the web 33. For this reason, in the conventional roll blade coating, the adhesion amount of the coating liquid in the vicinity of both ends of the web 33 becomes smaller than the adhesion amount thereof at the central part of the web 33, and the film thickness becomes uneven in the width direction.

To solve these problems, for example, in PTL 1 a roll blade coating apparatus is proposed, which can uniformly apply a coating liquid on a web in the width direction by providing a pressure detector which converts pressure of the blade in each position of the width direction into an electric signal.

However, in the roll blade coating apparatus described in PTL 1, pressing force of the web against the roll blade in the width direction cannot be adjusted by mechanical suppress strength, and since the roll blade itself cannot be pressed, the adhesion amount on the web in the width direction is hard to be effectively adjusted.

Moreover, to solve the above-described problems, in PTL 2 a roll blade coating method is proposed, in which an excessive amount of a coating liquid is transferred onto a continuously running web, and then a desired adhesion amount is adjusted with a roll blade so as to coat the web with the coating liquid, and the method includes at least a roll blade pressing step of pressing the roll blade via a holder to a web whose back surface is supported by a backup roll, wherein the roll blade is pressed with inclination of 15° to 45° in a travelling direction of the web with respect to a normal direction of the backup roll, and a tubular air containing chamber arranged to press the roll blade is divided into plural chambers along the width direction of the roll blade, and an air pressure in each of the plural tubular air containing chambers is separately adjusted to obtain uniform pressing force of the roll blade.

However, by the method disclosed in PTL 2, the tube cannot expand to relatively wide in both sides of the divided portions of the tube, and some parts of the tube cannot generate force to press the roll blade. Thus, the tube cannot be finely divided and an apparatus using the method cannot sufficiently function to solve the problems.

CITATION LIST

Patent Literature

PTL 1 Japanese Patent Application Laid-Open (JP-A) No. 05-015833

PTL 2 Japanese Patent Application Laid-Open (JP-A) No. 2005-279627

SUMMARY OF INVENTION

Technical Problem

The present invention aims to provide a roll blade coating method and a roll blade coating apparatus, which can suppress variations in adhesion amount of a coating liquid constantly occurring on a web in the width direction, specifically decrease in the adhesion amount of the coating liquid in the vicinity of both ends of the web in the width direction in roll blade coating, and obtain uniform adhesion amount of the coating liquid on the web in the width direction.

Solution to Problem

Means for solving the problems are as follows.

<1> A roll blade coating method including transferring an excessive amount of a coating liquid onto a continuously running web, and adjusting the excessive amount of the coating liquid to a desired adhesion amount with a roll blade, wherein the roll blade is held by a holding member for holding the roll blade, wherein the holding member is pressed by a plurality of air cylinders each configured to press the holding member, wherein the air cylinders are arranged in a side of the holding member, which side is opposite to a side where the holding member holds the roll blade, and wherein the air cylinders can separately be adjusted in air pressure.

<2> The roll blade coating method according to <1>, wherein the air pressure of each of the air cylinders arranged in the vicinity of both ends of the web in the width direction is adjusted to an air pressure lower than the average air pressure of the other operating air cylinders.

<3> The roll blade coating method according to any one of <1> and <2>, wherein the roll blade has a diameter of 8 mm to 15 mm.

<4> The roll blade coating method according to any one of <1> to <3>, wherein the air cylinder has an outer diameter of 10 mm to 50 mm.

<5> The roll blade coating method according to any one of <1> to <4>, wherein an arrangement pitch of the air cylinders is set to satisfy the relation: outer diameter D of air cylinder arrangement pitch<sum of 20 mm and outer diameter D of air cylinder.

<6> The roll blade coating method according to any one of <1> to <5>, wherein a flat plate member is provided between the holding member and the air cylinder such that a gravity center of the flat plate member fits a shaft of the air cylinder.

<7> The roll blade coating method according to <6>, wherein the flat plate member has a disc shape, and a diameter smaller than the arrangement pitch of the air cylinders.

<8> The roll blade coating method according to any one of <6> and <7>, wherein a part of the disc-shaped flat plate member, which part is brought into contact with a rod of the air cylinder, is formed into a concave spherical surface, and a head of the rod of the air cylinder is formed into a convex spherical surface.

<9> A roll blade coating apparatus including: a roll blade configured to adjust an excessive amount of a coating liquid on a continuously running web to a desired adhesion amount; a holding member for holding the roll blade; and a plurality of air cylinders each configured to press the holding member, wherein the air cylinders are arranged in a side of the holding member, which side is opposite to a side where the holding member holds the roll blade, and wherein the air cylinders can separately be adjusted in air pressure.

<10> The roll blade coating apparatus according to <9>, wherein the air pressure of each of the air cylinders arranged in the vicinity of both ends of the web in the width direction is adjusted to an air pressure lower than the average air pressure of the other operating air cylinders.

<11> The roll blade coating apparatus according to any one of <9> and <10>, wherein the air pressures of the air cylinders are gradually and simultaneously increased to desired air pressures from pressures lower than the desired air pressures.

<12> The roll blade coating apparatus according to any one of <9> to <11>, wherein the air pressures of the air cylinders are displayed correspondingly to the arrangement of the air cylinders.

Advantageous Effects of Invention

The present invention can solve the conventional various problems, and achieve the objects, and can provide a roll blade coating method and a roll blade coating apparatus, which can suppress variations in adhesion amount of a coating liquid constantly occurring on a web in the width direction, specifically decrease in the adhesion amount of the coating liquid in the vicinity of both ends of the web in the width direction in roll blade coating, and obtain uniform adhesion amount of the coating liquid on the web in the width direction.

Figure 1:
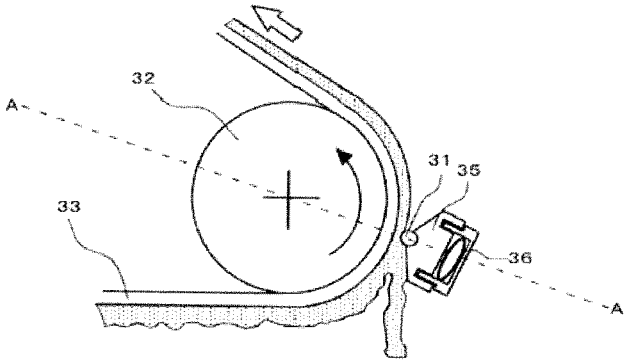
FIG. 1 Prior Art
FIG. 1 is a diagram for explaining a conventional roll blade coating method.
Figure 2:
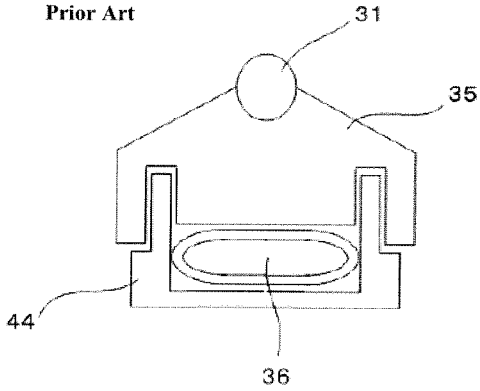
FIG. 2 Prior Art
FIG. 2 is an exemplary schematic diagram of the conventional roll blade coating apparatus used in FIG. 1.

DESCRIPTION OF EMBODIMENTS (Roll Blade Coating Method and Roll Blade Coating Apparatus)

A roll blade coating method of the present invention includes transferring an excessive amount of a coating liquid onto a continuously running web, and adjusting the excessive amount of the coating liquid to a desired adhesion amount with a roll blade, wherein the roll blade is held by a holding member for holding the roll blade, wherein the holding member is pressed by a plurality of air cylinders each configured to press the holding member, wherein the air cylinders are arranged in a side of the holding member, which side is opposite to a side where the holding member holds the roll blade, and wherein the air cylinders can separately be adjusted in air pressure.

A roll blade coating apparatus includes a roll blade configured to adjust an excessive amount of a coating liquid on a continuously running web to a desired adhesion amount, a holding member for holding the roll blade, and a plurality of air cylinders each configured to press the holding member, wherein the air cylinders are arranged in a side of the holding member, which side is opposite to a side where the holding member holds the roll blade, and wherein the air cylinders can separately be adjusted in air pressure.

In the present invention, it is preferred that an air pressure of each of the air cylinders arranged in the vicinity of both ends of the web in the width direction be adjusted to an air pressure lower than the average air pressure of the other operating air cylinders, from the standpoint of achieving uniform adhesion amount of a coating liquid on the web in the width direction.

In the specification, the vicinity of both ends of the web in the width direction means areas each extending from each end to a distance of 100 mm in both directions in the width direction. In other words, the vicinity ranges from a position on the web at a distance of 100 mm from the end to a position out of the web at a distance of 100 mm from the end (the latter position is not on the web).

As a method of adjusting an air pressure of each of air cylinders arranged in the vicinity of both ends of the web in the width direction to an air pressure lower than the average air pressure of the other operating air cylinders, there is a method of adjusting an air pressure using a regulator.

The degree of adjustment of the air pressure of each of the air cylinders arranged in the vicinity of both ends of the web in the width direction to an air pressure lower than the average air pressure of the other operating air cylinders is not particularly limited and may be appropriately selected depending on the intended purpose.

The average air pressure of the air cylinders other than those arranged in the vicinity of both ends of the web in the width direction is not particularly limited and may be appropriately adjusted depending on the intended purpose. It is preferably 0.13 MPa to 0.28 MPa.

The structure, size (width, length), and material, etc. of the roll blade are not particularly limited and may be appropriately selected depending on the intended purpose.

The shape, structure, size (width, length), and material, etc. of the backup roll are not particularly limited and may be appropriately selected depending on the intended purpose. For example, as to the shape, a cylindrical shape is preferable. The outer periphery of the backup roll is preferably coated with an elastic body. Examples of the elastic body include a natural rubber, a synthesis rubber, a resin, and a thermoplastic elastomer.

The shape, structure, size (width, length), and material, etc. of the web are not particularly limited and may be appropriately selected depending on the intended purpose. Examples of the web include various base materials. Examples of the material of the web include paper, plastics, metals, and woods. Examples of the shape of the web include a sheet shape, a band shape, and a roll shape.

The shape, structure, size (width, length), and material, etc. of the holder are not particularly limited and may be appropriately selected depending on the intended purpose. Examples of the material of the holder include rubbers, plastics, and metals.

Figure 4:
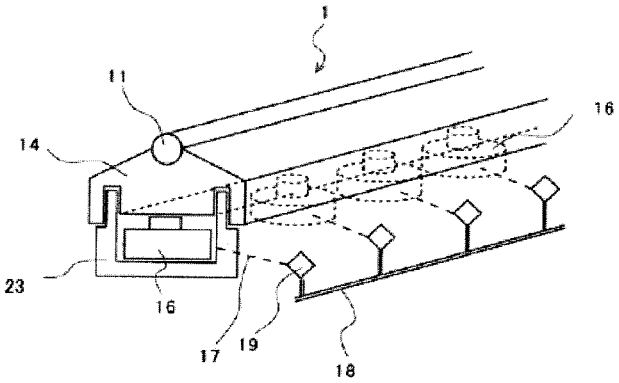
FIG. 4 is a diagram showing an example of a roll blade coating apparatus of the present invention.

Here, FIG. 4 is a diagram showing an example of a roll blade coating apparatus of the present invention.

The roll blade coating apparatus of the present invention is a roll blade coating apparatus using a method including transferring an excessive amount of a coating liquid onto a continuously running web (a base material made of a woven fabric or a nonwoven fabric), and adjusting the excessive amount of the coating liquid to a desired adhesion amount with a roll blade. The web runs at high speed to improve productivity. Thus, a roll blade coating apparatus 1 of the present invention includes a roll blade 11 for measuring a coating liquid, a holding member 14 for holding the roll blade 11, in a back surface of the roll blade 11 a plurality of air cylinders 16 for uniformly pressing the holding member 14 against a web 13, and a holder 23 for holding the air cylinders 16.

Moreover, a tube 17 for supplying air pressure is connected to the air cylinder 16, in the tube 17, a pressure regulator 19 for reducing pressure of a common tube 18 to a certain pressure is provided.

Figure 5:
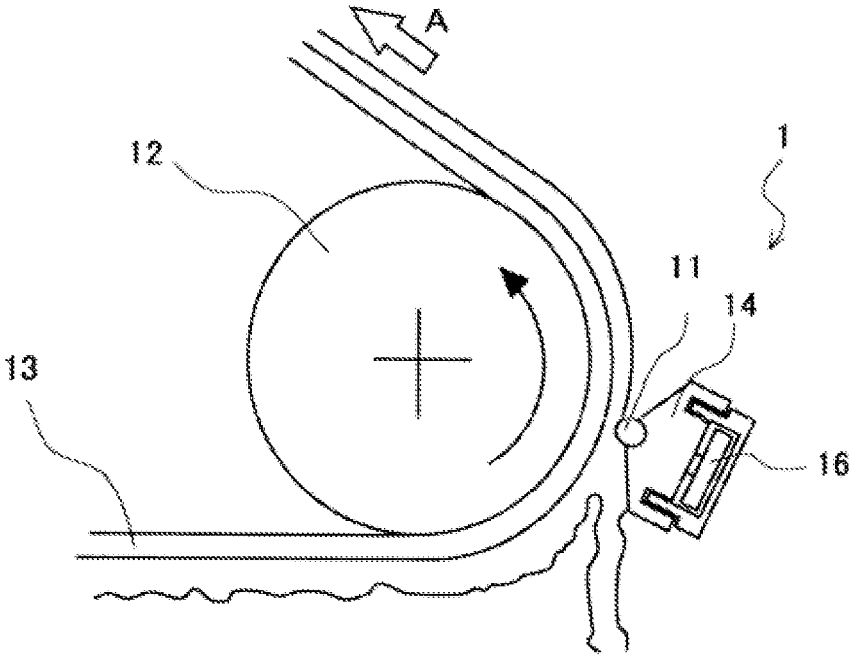
FIG. 5 is a schematic diagram showing an example of a roll blade coating method using the roll blade coating apparatus of the present invention.

FIG. 5 is a schematic diagram showing an example of a roll blade coating method using the roll blade coating apparatus of the present invention.

The roll blade 11 of the roll blade coating apparatus 1 of the present invention is held by the holding member 14, and an air cylinder 16 pressing the holding member 14 is arranged in a side of the holding member 14 which side is opposite to a side where the roll blade 11 is held.

The roll blade 11 supported by the air cylinder 16 is brought into contact with the web 13 which is running while held by a backup roll 12, and the air cylinder 16 is appropriately set to remove the excessive amount of the coating liquid, to thereby obtain a desired adhesion amount of the coating liquid on the web 13.

As shown in FIG. 4, in the roll blade coating apparatus 1 of the present invention, a plurality of the air cylinders 16 configured to press the holding member 14 are arranged in a side of the holding member 14, which side is opposite to a side where the roll blade 11 is held. With the plurality of the air cylinders 16, pressing force against the web 13 is appropriately set, and pressing force in the width direction is adjusted to suppress deformation of the roll blade 11 in the width direction. Therefore, the coating liquid can be applied in a desired, uniform adhesion amount in the width direction on the web 13, to form a film having a uniform thickness.

Moreover, in the roll blade coating apparatus of the present invention, the diameter of the roll blade is selected from the range of 8 mm to 15 mm.

Figure 3:
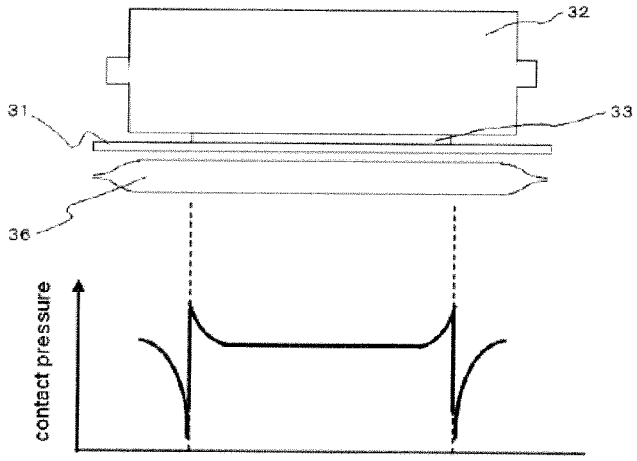
Prior Art FIG. 3
FIG. 3 is a conceptual diagram of a cross-section of A-A line in FIG. 1 and a contact pressure between a roll blade and a backup roll corresponding to the width direction position of the cross-section.

Even though the roll blade coating apparatus 1 shown in FIG. 4 is used, as shown in FIG. 3 the contact pressure in the vicinity of both ends of the web in the width direction increases.

However, when a pressing force of the roll blade 11 against the web 13 increases at both ends, the air pressure of the air cylinder 16 with respect to the part where the pressing force increases can be adjusted by appropriately reducing pressure using the pressure regulator 19, to thereby adjust the pressing force. Thus, uniform adhesion amount in the width direction can be obtained.

At that time, the diameter of the roll blade 11 is selected within the range of 8 mm to 15 mm. When the diameter of the roll blade 11 is smaller than 8 mm, the force of the holding member 14 for holding the roll blade 11 is not sufficient, dropping out of the roll blade 11 during coating may easily occur. On the other hand, when the diameter of the roll blade 11 is larger than 15 mm, there increases a possibility that so-called bead streaks, which are small pitch streaks, are generated all over the surface, and rigidity of the roll blade 11 increases. Thus, even though the air pressure of the air cylinder 16 is minutely adjusted in the width direction, the pressing force of the roll blade 11 against the web 13 in the width direction becomes less effective, and it becomes difficult to finely adjust adhesion amount of the coating liquid.

Figure 6:
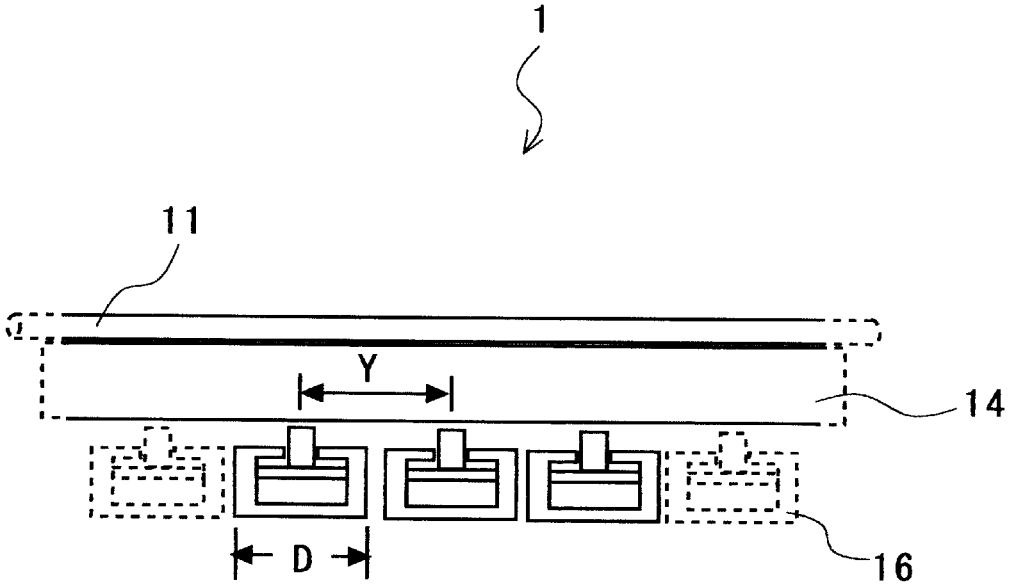
FIG. 6 is a diagram showing the state of air cylinders and arrangement thereof in the roll blade coating apparatus of the present invention.

FIG. 6 is a diagram showing the state of air cylinders and arrangement thereof in the roll blade coating apparatus of the present invention.

In the roll blade coating apparatus 1 of the present invention, the outer diameter D of the air cylinder 16 is selected from the range of 10 mm to 50 mm, with preference being given to 20 mm to 30 mm.

When the outer diameter D of the air cylinder 16 is smaller than 10 mm, even though a large number of air cylinders 16 are arranged, it is necessary to set an air pressure fed to the air cylinder 16 to relatively high.

Thus, when the air cylinder 16 is operated at high air pressure, troubles easily occur in various parts. There causes a problem that in the case where a large number of the air cylinders 16 are required, the cost of devices including the pressure regulators 19 increases.

When the outer diameter D of the air cylinder 16 is larger than 50 mm, an area to be pressed by one of the air cylinders 16 increases, and the pressing force in the width direction cannot be finely adjusted.

In the roll blade coating apparatus 1 of the present invention, as shown in FIG. 6, an arrangement pitch Y between the air cylinders 16 is represented by the following relation: the outer diameter D of air cylinder 16≤arrangement pitch<sum of 20 mm and the outer diameter D of air cylinder 16. Moreover, the arrangement pitch Y is preferably represented by the following relation: the outer diameter D of air cylinder 16≤arrangement pitch<sum of 10 mm and the outer diameter D of air cylinder 16.

When the arrangement pitch Y is equal to or larger than sum of 20 mm and the outer diameter D of the air cylinder 16, it is necessary to set an air pressure fed to the air cylinder 16 higher than that when the air cylinders 16 are densely arranged. When the air cylinder 16 is operated at high air pressure, troubles easily occur in various parts, and moreover an area to be pressed by one of the air cylinders 16 increases, and the pressing force in the width direction cannot be finely adjusted.

Therefore, by setting the arrangement pitch Y to a value smaller than the sum of 20 mm and the outer diameter D of the air cylinder 16, preferably a value smaller than the sum of 10 mm and the outer diameter D of the air cylinder 16, a width of the part to be pressed by one of the air cylinders 16 becomes appropriate, and the pressing force in the width direction can be finely adjusted.

Note that each air cylinder 16 is mainly consisting of a cylinder and a piston, and it is preferred that the diameter of the piston be as large as possible, and that the inner diameter of the air cylinder, i.e., the diameter of the cylinder be as large as possible. Thus, the thickness of the air cylinder is made as thin as possible in consideration of the pressure applied to the piston, the cylinder and the like.

Figure 7:
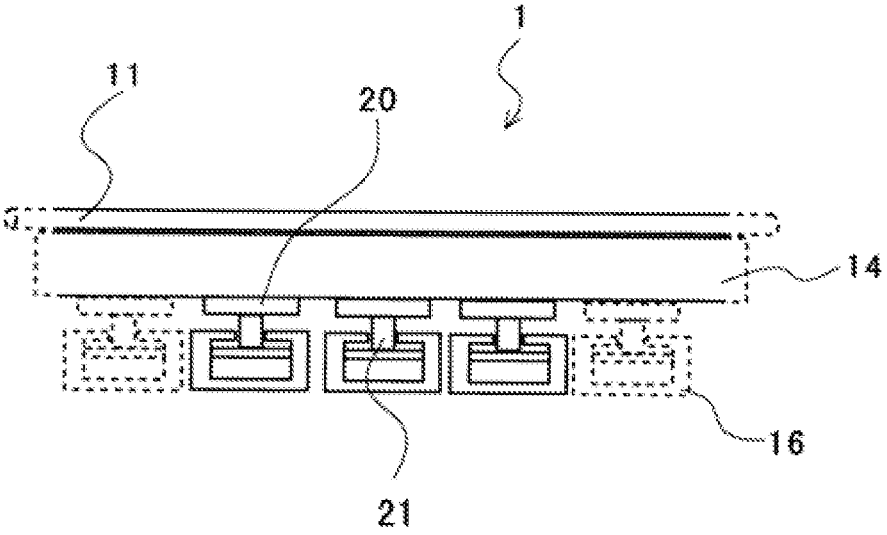
FIG. 7 is a diagram showing the state of a flat plate member in the roll blade coating apparatus of the present invention.

FIG. 7 is a diagram showing the state of a flat plate member in the roll blade coating apparatus of the present invention.

In the roll blade coating apparatus 1 of the present invention, a flat plate member 20 is provided between the holding member 14 for holding the roll blade 11 and the air cylinder 16 such that a gravity center of the flat plate member 20 fits a shaft of the air cylinder 16. This flat plate member 20 allows air pressure applied by a rod 21 of the air cylinder 16 to uniformly apply through the holding member 14 in the width direction.

The holding member 14 somewhat changes its shape by application of the pressing force. Even though the holding member 14 is deformed, the flat plate member 20 is fastened to the rod 21 with allowance, so that the flat plate member 20 comes into close contact with the holding member 14. Consequently, the air pressure can be uniformly applied through the holding member 14 in the width direction so as to cancel the deformation of the holding member 14.

Moreover, since the flat plate member 20 is formed into a disc shape, even though the flat plate member 20 is rotated or inclined on the rod 21, it is possible to prevent the flat plate member 20 from being in contact with and interference to an adjacent flat plate member 20. As a result, it is not necessary to form a large space between the flat plate members 20, and the diameter of the flat plate member 20 can be set slightly smaller than the arrangement pitch Y between the air cylinders 16.

Moreover, the flat plate members 20 can minimize an area of the holding member 14 for the roll blade 11, to which area the air pressure cannot be applied by the air cylinder 16, thus the pressing force in the width direction can be more uniformly applied.

Figure 8:
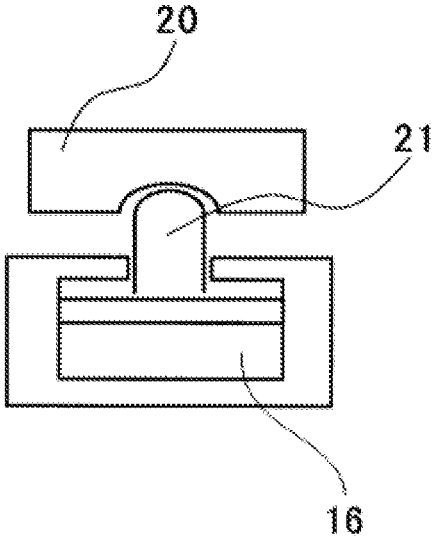
FIG. 8 is a diagram showing the state of a flat plate member and a rod of an air cylinder.

FIG. 8 is a diagram showing the state of a flat plate member and a rod of an air cylinder.

A part of the flat plate member 20, which part is brought into contact with the rod 21 of the air cylinder 16 is formed into a downward-facing concave spherical surface in FIG. 8, and a head of the rod 21 of the air cylinder 16 is formed into a convex spherical surface in FIG. 8, so as to stabilize the contact between the flat plate member 20 and the rod 21. This increases flexibility of the contact between the flat plate member 20 and the rod 21. Therefore, the close contact between the flat plate member 20 and the holding member 14 for the roll blade 11 is more easily secured, and the uniformity of the pressing force in the width direction can be more improved.

Figure 9:
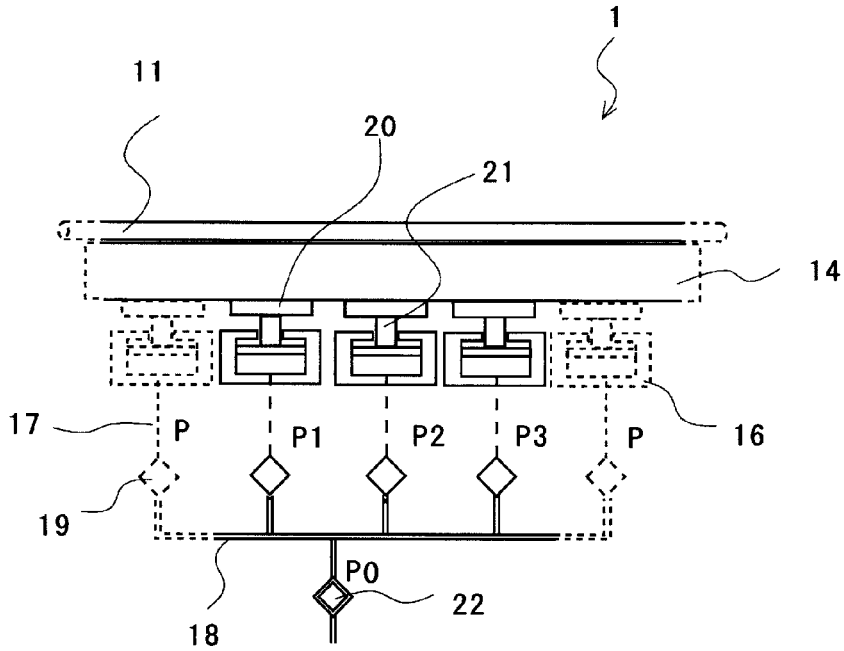
FIG. 9 is a diagram showing a method of adjusting air pressure.

FIG. 9 is a diagram showing a method of adjusting air pressure.

While the roll blade coating apparatus 1 of the present invention performs coating using a main pressure regulator 22 an air pressure P0 of the common tube 18 is set higher than certain air pressures P1, P2, and P3, etc. adjusted in and transmitted through the pressure regulators 19.

At the beginning of the coating with the roll blade coating apparatus 1 of the present invention, in order to avoid the web 13 from fracturing, it is necessary to gradually increase a pressing force of the roll blade 11 against the web 13 to a certain value. Thus, in the roll blade coating apparatus 1 of the present invention, the coating is started with setting the air pressures P1, P2, and P3, etc. to pressures lower than the certain values, followed by simultaneously increasing the air pressures to respective certain air pressures P1, P2, and P3, etc.

The air pressure PO of the common tube 18 is set to an air pressure for performing continuous coating using the main pressure regulator 22.

Next, using the pressure regulators 19, the air pressures P1, P2, and P3, etc. are adjusted to certain values.

Moreover, using the main regulator 12, by reducing the air pressure P0 to an air pressure lower than the air pressure for performing continuous coating with maintaining the setting of the pressure regulator 19, the air pressures P1, P2, and P3, etc. can also be reduced, and the roll blade coating apparatus 1 is ready for starting the coating.

At the beginning of the coating, the roll blade 11 is pressed against the web 3 by applying the air pressure P0 which is lower than the air pressure for performing continuous coating, and the air pressure P0 is increased to the air pressure for performing continuous coating, so as to achieve the start of the coating with avoiding the web 3 from fracturing.

Figure 10A:
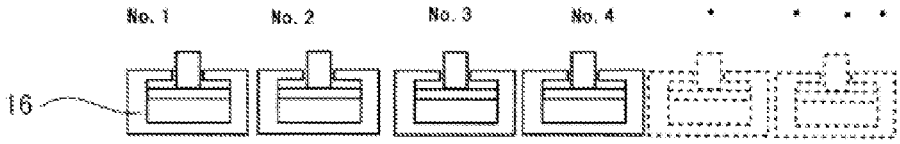
FIG. 10A is a diagram showing an arrangement of the air cylinders of the roll blade coating apparatus of the present invention.
Figure 10B:
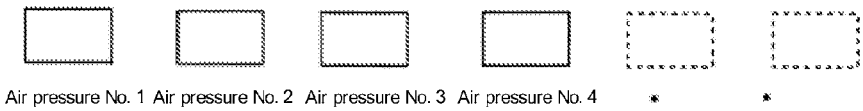
FIG. 10B is a diagram showing a display of a pressure of each of the cylinders.

FIG. 10A is a diagram showing an arrangement of the air cylinders of the roll blade coating apparatus of the present invention, and FIG. 10B is a diagram showing a display of a pressure of each of the cylinders.

A plurality of the air cylinders 16 are arranged with respect to the width direction of the web 13 and the roll blade 11.

It may be required to finely adjust the air pressure of each of the air cylinders 16 during coating. In order to easily adjust the air pressure of each of the air cylinders 16, the air pressure of each of the air cylinders 16 is displayed, to thereby secure fine adjustment of each air pressure.

EXAMPLES

Hereinafter, Examples of the present invention will be specifically described, however, the present invention is not limited to these disclosed Examples.

Example 1

Using the roll blade coating apparatus of the present application shown in FIG. 4, coating was performed under the following conditions and while the adhesion amount of a coating liquid on a web in the width direction was confirmed using an on-line adhesion amount meter, the air pressure of each air cylinder was adjusted to minimize deviation in the adhesion amount thereof on the web in the width direction.

Figure 11:
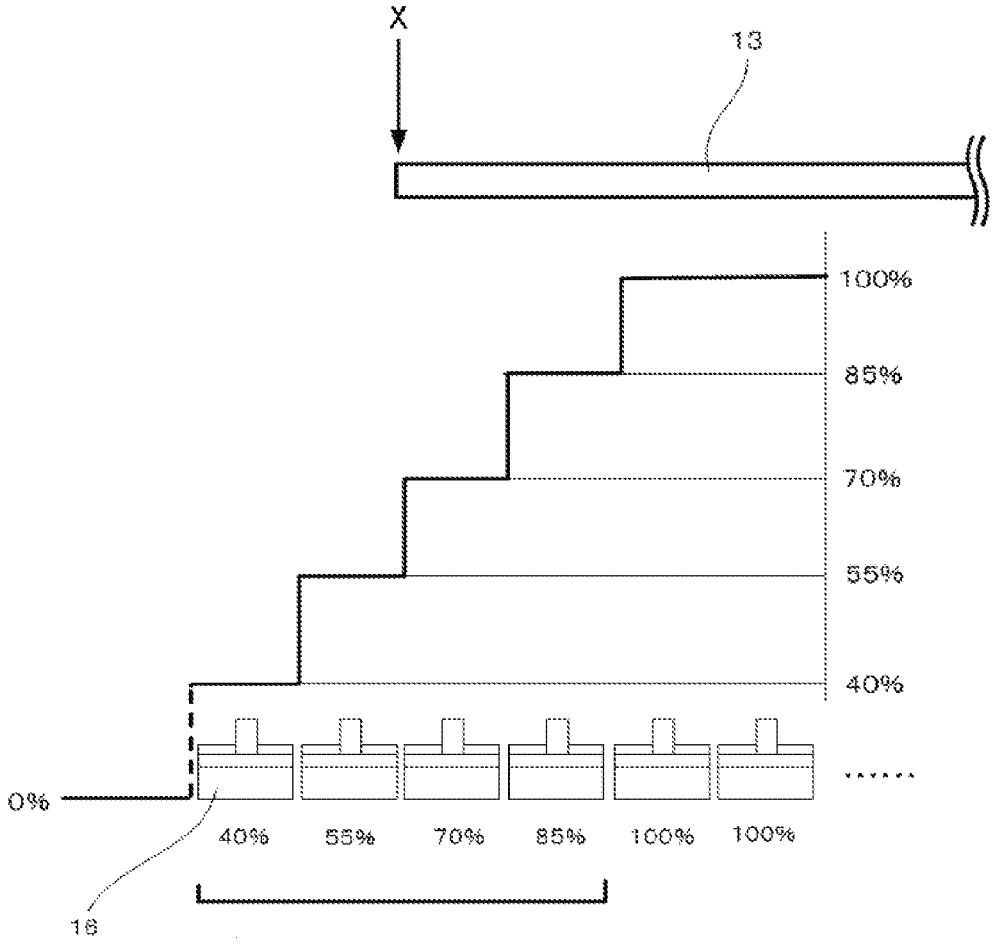
FIG. 11 is a diagram showing a method of adjusting air pressures of four air cylinders which are arranged in the vicinity of each of both ends of the web in the width direction in Examples 1 and 2.

Specifically, as shown in FIG. 11, the pressures of four air cylinders 16 in the vicinity of each of the both ends of the web were reduced in 4 steps so as to be reduced in each step by 15% with respect to the average air pressure (100%) of the other 56 operating air cylinders. The air cylinders were arranged in such a manner that the edge of the web 13 was located substantially on the middle of the four air cylinders 16 in the width direction (X in FIG. 11).

Finally, the minimum deviation which could be adjusted was 3.6%.

(1) Coating base (web): woodfree paper having a basis weight of 62 g/m$^2$, a thickness of 70 μm, and a width of 1,560 mm
(2) Coating liquid: 10% by mass of aqueous polyvinyl alcohol (PVA) solution
(3) Coating rate: 400 m/min
(4) Outer diameter of roll blade: 12 mm
(5) Length of roll blade: 2,300 mm
(6) Outer diameter of air cylinder: 20 mm
(7) Arrangement pitch of cylinders: 26 mm
(8) Number of arranged cylinder: 80
Number of operating cylinder: 64

The deviation in adhesion amount of the coating liquid on the web in the width direction was obtained by the following Equation (1).

$$\text{Deviation in adhesion amount of a coating liquid in the width direction (\%)} = \{(\text{maximum adhesion amount (g/m}^2) - \text{minimum adhesion amount (g/m}^2))/\text{average adhesion amount (g/m}^2))\times 100 \quad \text{Equation (1)}$$

Example 2

Using a roll blade coating apparatus of the present invention, in which a part of the disc-shaped flat plate member 20, which part is brought into contact with the rod 21 of the air cylinder 16 is formed into a downward-facing concave spherical surface, and a head of the rod 21 of the air cylinder 16 is formed into a convex spherical surface shown in FIGS. 7 and 8, coating was performed under the following conditions and while the adhesion amount of a coating liquid on a web in the width direction was confirmed using the on-line adhesion amount meter, the air pressure of each air cylinder was adjusted to minimize deviation in the adhesion amount thereof on the web in the width direction.

Specifically, as shown in FIG. 11, the pressures of four air cylinders 16 in the vicinity of each of the both ends of the web were reduced in 4 steps so as to be reduced in each step by 15% with respect to the average air pressure (100%) of the other 56 operating air cylinders. The air cylinders were arranged in such a manner that the edge of the web 13 was located substantially on the middle of the four air cylinders 16 in the width direction (X in FIG. 11).

Finally, the minimum deviation which could be adjusted was 3.1%.

(1) Coating base (web): woodfree paper having a basis weight of 62 g/m$^2$, a thickness of 70 μm, and a width of 1,560 mm
(2) Coating liquid: 10% by mass of aqueous polyvinyl alcohol (PVA) solution
(3) Coating rate: 400 m/min
(4) Outer diameter of roll blade: 12 mm
(5) Length of roll blade: 2,300 mm
(6) Outer diameter of air cylinder: 20 mm
(7) Arrangement pitch of cylinders: 26 mm
(8) Number of arranged cylinder: 80
Number of operating cylinder: 64
(9) Diameter of disc: 25 mm

Example 3

Figure 12:
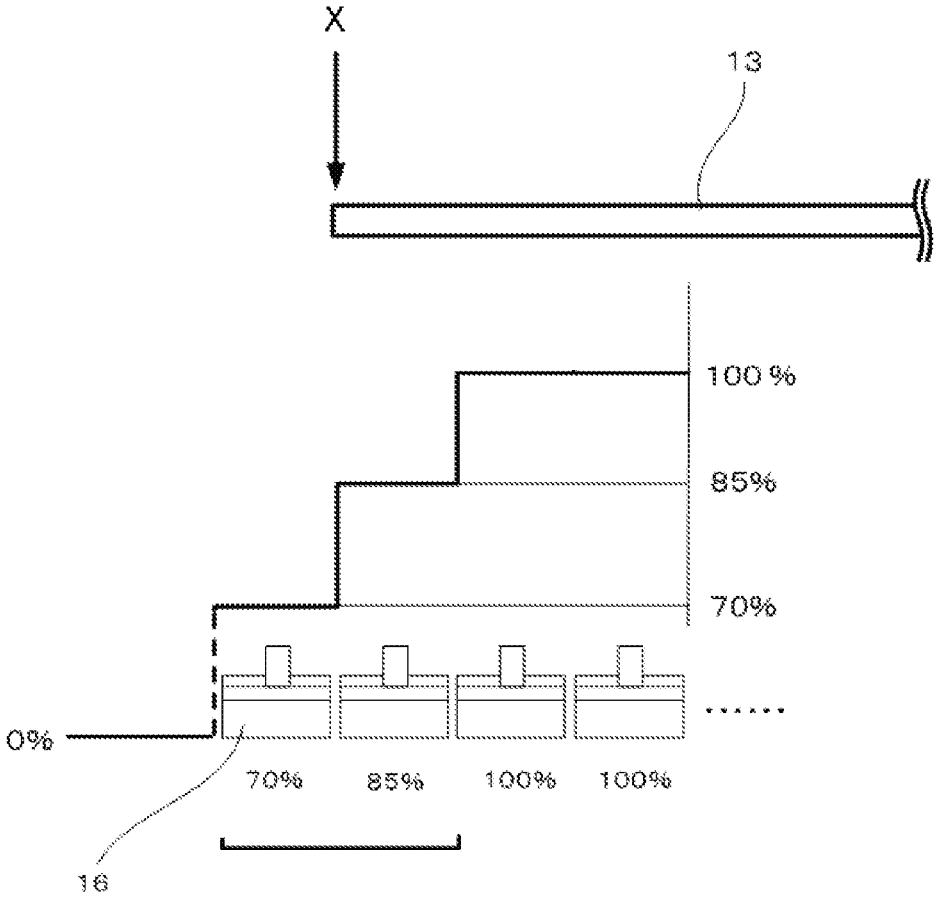
FIG. 12 is a diagram showing a method of adjusting air pressures of two air cylinders which are arranged in the vicinity of each of both ends of the web in the width direction in Example 3.

The deviation in adhesion amount of a coating liquid on a web in the width direction was minimized in the same manner as in Example 1, except that, as shown in FIG. 12, the pressures of two air cylinders 16 in the vicinity of each of the both ends of the web were reduced in 2 steps so as to be reduced in each step by 15% with respect to the average air pressure (100%) of the other 58 operating air cylinders. The air cylinders 16 were arranged in such a manner that the edge of the web 13 was located substantially on the middle of the two air cylinders 16 in the width direction (X in FIG. 12).

The number of arranged cylinder: 80

The number of operating cylinder: 62

Finally, the minimum deviation which could be adjusted was 3.9%.

Comparative Example 1

Using a conventional roll blade coating apparatus, as shown in FIG. 3, coating was performed under the following conditions by means of uniform pressing force using the tubular air containing member 36 and while the adhesion amount of a coating liquid on a web in the width direction was confirmed using the on-line adhesion amount meter, the air pressure inside the tubular air containing member was adjusted so as to obtain the same adhesion amount thereof on the web in the width direction as those in Examples 1 to 3.

There is a large difference in the adhesion amount between the central part of the web in the width direction and ends of the web in the width direction, and finally the minimum deviation which could be adjusted was 8.7%.

(1) Coating base (web): woodfree paper having a basis weight of 62 g/m$^2$ and a thickness of 70 μm
(2) Coating liquid: 10% by mass of aqueous polyvinyl alcohol (PVA) solution
(3) Coating rate: 400 m/min
(4) Outer diameter of roll blade: 12 mm
(5) Length of roll blade: 2,300 mm
(6) Pressing width: 2,080 mm According to the present invention, a coating liquid is applied in a uniform adhesion amount on a web in the width direction, since in the roll blade coating decrease in the adhesion amount of the coating liquid on the web in the width direction in the vicinity of both ends of the web can be corrected.

REFERENCE SIGNS LIST

1 roll blade coating apparatus
11 roll blade
12 backup roll
13 web
14 holding member
16 air cylinder
17 tube
18 common tube
19 pressure regulator
20 flat plate member
21 rod
22 main pressure regulator
23 holder
31 roll blade
32 backup roll
33 web
34 coating liquid
35 holding member
36 tubular air containing member
44 holder
A travelling direction of web
D outer diameter of air cylinder
Y arrangement pitch of air cylinders
P0 air pressure of common tube
P1, P2, P3 air pressure of air cylinder

The invention claimed is:

1. A roll blade coating apparatus comprising:

a roll blade configured to adjust an excessive amount of a coating liquid on a continuously running web to a desired adhesion amount;

a holding member for holding the roll blade;

a plurality of air cylinders each configured to press the holding member; and a plurality of pressure regulators to regulate air pressure of the air cylinders, wherein the air cylinders are arranged in a side of the holding member, which side is opposite to a side where the holding member holds the roll blade, wherein the air cylinders can separately be adjusted in air pressure, and wherein the air cylinders directly press the holding member.

2. The roll blade coating apparatus according to claim 1, wherein each pressure regulator amongst the plurality of pressure regulators is configured to adjust the air pressure of a corresponding air cylinder to an air pressure lower than an average air pressure of the other operating air cylinders.

3. The roll blade coating apparatus according to claim 1, wherein each pressure regulator amongst the plurality of pressure regulators is configured to gradually and simultaneously increase the air pressure of a corresponding air cylinder to a desired air pressure from the pressure lower than the desired air pressure.

4. The roll blade coating apparatus according to claim 1, further comprising a display, wherein the air pressures of the air cylinders are displayed on the display correspondingly to the arrangement of the air cylinders.

* * * * *